United States Patent [19]

Hyde

[11] Patent Number: 4,596,117

[45] Date of Patent: Jun. 24, 1986

[54] HYDROJET

[75] Inventor: Robert W. Hyde, Crystal River, Fla.

[73] Assignee: Hyde Power Systems Inc., Crystal River, Fla.

[21] Appl. No.: 706,191

[22] Filed: Feb. 27, 1985

[51] Int. Cl.[4] ..... B63H 11/00

[52] U.S. Cl. ..... 60/221; 417/352; 440/38; 91/499

[58] Field of Search ..... 60/221, 222; 417/348, 417/352, 353, 354, 392, 393; 440/38, 39, 44, 45; 91/499

[56] References Cited

U.S. PATENT DOCUMENTS

| | | | |
|---|---|---|---|
| 1,632,357 | 6/1927 | White | 417/354 |
| 3,048,140 | 8/1962 | Davis | 60/221 |
| 3,347,045 | 10/1967 | Warren | 440/41 |
| 3,408,898 | 11/1968 | Hamlin | 91/499 |
| 3,439,766 | 4/1969 | Dence et al. | 91/499 |
| 4,343,611 | 8/1982 | Scott-Scott | 440/45 |

*Primary Examiner*—Louis J. Casaregola

[57] ABSTRACT

A gas powered engine for use in combination with a pressurized gas source to propel the gas powered engine through a fluid medium such as water comprising an engine housing having a plurality of blades formed on the outer periphery thereof held in fixed spaced relationship to an outer hollow substantially frustum housing by an attachment structure to cooperatively form a fluid flow chamber therebetween, the engine housing comprising a hollow substantially cylindrical housing to operatively house a drive assembly therein, the drive assembly comprising a drive shaft assembly coupled to the attachment structure in fixed relationship relative to the hollow substantially cylindrical housing, having a gas distribution structure mounted thereon, and a cylinder assembly and a swash plate assembly rotatably mounted thereon, the gas distribution structure being operatively disposed between the pressurized gas source and the cylinder assembly to selectively feed and discharge pressurized gas to and from the cylinder assembly, the cylinder assembly comprising a substantially cylindrical cylinder block having a plurality of hollow cylinders formed therein to receive a corresponding plurality of piston assemblies therein for reciprocal movement within the corresponding hollow cylinders for translational movement of the swash plate assembly in response to the pressurized gas feed to the individual piston assemblies to rotate the engine housing to propel the gas powered engine through the water.

35 Claims, 12 Drawing Figures

FIG. 1
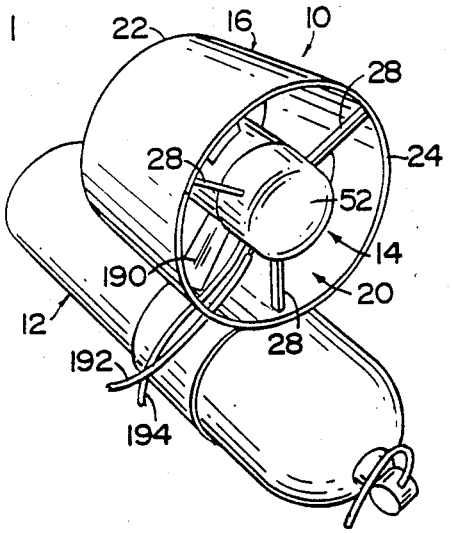
FIG. 3
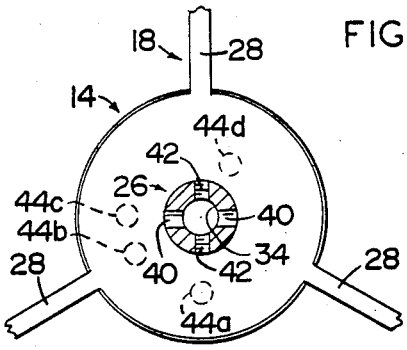
FIG. 4
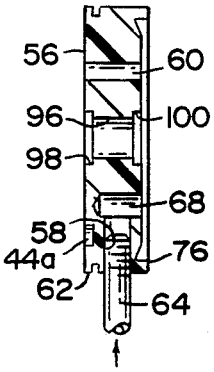
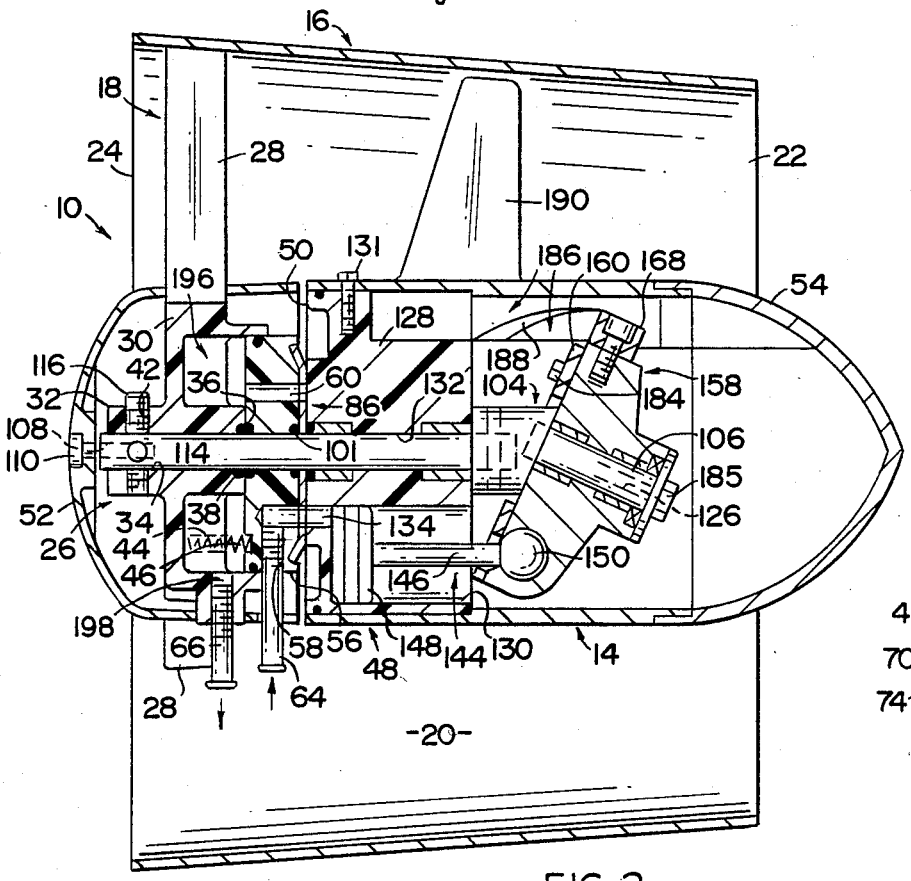
FIG. 2
FIG. 5
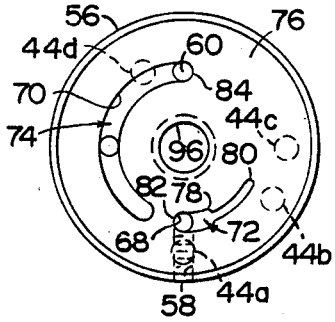
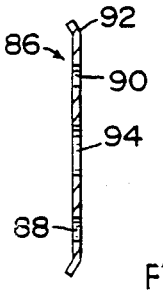
FIG. 6
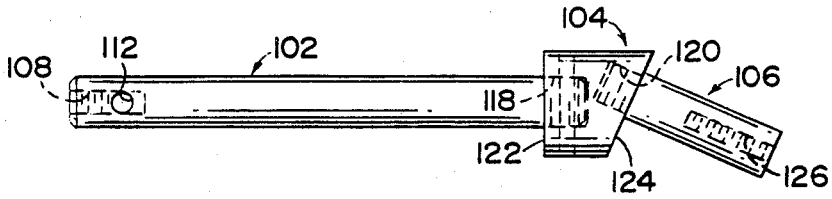
FIG. 7

FIG. 8
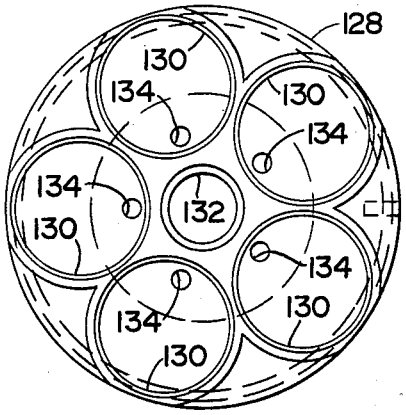
FIG. 9
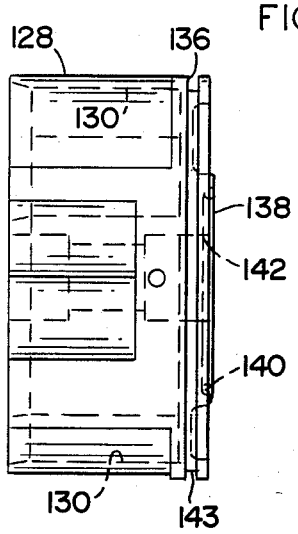
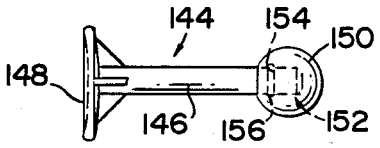
FIG. 10
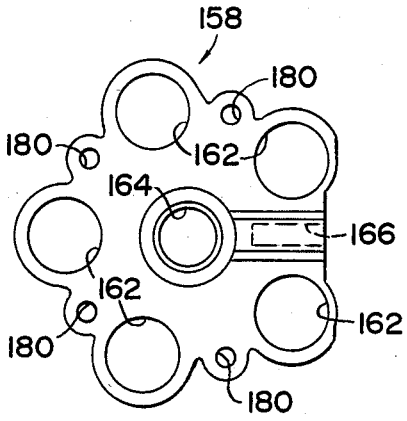
FIG. 11
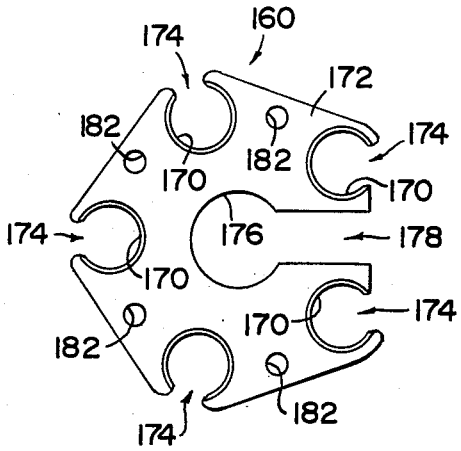
FIG. 12

HYDROJET

BACKGROUND OF THE INVENTION

1. Field of the Invention

A gas powered engine for use with a pressurized gas source.

2. Description of the Prior Art

Various efforts have been made to provide for underwater propulsion for use by individuals. Such efforts are typically represented by a battery operated or powered motors including propeller means to locamote the user under water. Unfortunately, the storage power capability of such power devices is extremely limited.

SUMMARY OF THE INVENTION

The present invention relates to a gas or air powered engine generally for use with a pressurized gas or air source such as an oxygen reservoir or tank used with a SCUBA system. The gas or air powered engine comprises an engine housing held in spaced relation relative to an outer hollow housing to cooperatively form a fluid flow chamber therebetween.

The engine housing comprises a hollow substantially cylindrical housing to operatively house a cylinder assembly and swash plate assembly therein.

The gas or air powered engine includes a drive assembly comprising a gas or air distribution means, the drive shaft assembly, the cylinder assembly and the swash plate assembly to rotate the engine housing within the outer hollow substantially frustrum housing.

The gas or air distribution means comprises a substantially cylindrical valve body having an inlet supply channel and an outlet discharge channel. An inlet supply member and an outlet discharge member are attached to the substantially cylindrical valve body in open fluid communications with the inlet supply channel and the outlet discharge channel respectively to couple the gas or air distribution means to the pressurized gas or air source. An inlet supply chamber and an outlet discharge chamber formed in the substantially cylindrical valve body terminate in an arcuate inlet supply port and an arcuate outlet discharge port formed on the inner surface of the substantially cylindrical valve body. The inlet supply chamber and the outlet discharge chamber are in open fluid communication with the inlet supply channel and the outlet discharge channel respectively to selectively feed pressurized gas or air to and from the cylinder assembly through the arcuate inlet supply port and the arcuate outlet supply port.

The drive shaft assembly comprises an elongated main drive shaft, eccentric shaft coupler and eccentric drive shaft held in fixed relationship relative to the hollow substantially cylindrical housing. The eccentric shaft coupler includes a first and second shaft recess to receive the elongated main drive shaft and eccentric drive shaft respectively. Alternately, the eccentric shaft coupler and eccentric drive shaft may be integrally formed. The front surface and rear surface of the eccentric shaft coupler form a first and second shoulder to engage the cylinder assembly and swash plate assembly respectively.

The cylinder assembly comprises a substantially cylindrical cylinder block including having a plurality of hollow cylinders formed therein, secured to the forward portion of the hollow substantially cylindrical housing. Each hollow cylinder has a gas or air port formed on a substantially circular front wall.

A corresponding piston assembly comprising a connecting rod having a cup shaped or concave piston disc attached to the inner end thereof and a spherical element press fitted to the outer end thereof is partially disposed in each of the hollow cylinders.

The swash plate assembly comprises a swash disc and piston lock plate. The swash disc includes a plurality of hemispherical recesses disposed about the circumference thereof to receive a corresponding spherical element. A first guide attachment slot is formed in the periphery of the swash disc to receive guide member therein. The piston lock plate comprises a plurality of circular apertures formed in a substantially flat lock plate. The cross-sectional diameter of each of the circular apertures is slightly less than the cross-sectional diameter of spherical elements. Access openings or channels are formed on the periphery of the substantially flat lock plate to permit the corresponding piston assembly to be operatively mounted in the swash plate assembly. A second guide attachment slot is formed in the periphery of the substantially flat piston lock plate to receive the guide member when the first and second guide attachment slots are in registry or alignment relative to each other.

A pair of guide elements are fixedly attached to the inner periphery of the hollow substantially cylindrical housing to cooperatively form a guide channel therebetween to operatively receive the guide member to permit reciprocal movement of the swash plate assembly as the swash plate assembly rotates with the cylinder assembly and drive assembly within the engine housing during operation.

A propeller means comprising a plurality of propellers is attached to the outer periphery of the engine housing to provide the fluid propulsion motion of the gas or air powered engine.

In use, the gas or air powered engine is coupled to the pressurized gas or air reservoir or tank by a gas or air supply and return lines respectively to feed pressurized gas or air to and from the gas or air powered engine.

To use, the operator actuates a control means to feed pressurized gas or air from the tank to the gas powered engine. The pressurized gas enters the gas distribution means through the inlet supply member and inlet supply channel to the inlet supply chamber. The pressurized gas is introduced into the substantially cylindrical cylinder block in fluid registry with the inlet supply chamber through the arcuate inlet supply port and gas port. The pressure of the pressurized gas on the cup shaped piston disc is transmitted through the corresponding connecting rod to the swash plate assembly through the mechanical coupling between the corresponding spherical element and the corresponding hemispherical recess rotating the swash plate assembly. This, in turn, causes the entire substantially cylindrical housing to rotate through the mechanical coupling of the guide member moving reciprocally within the guide channel cooperatively formed between the pair of guide elements. This rotational movement causes and permits the propeller blades to move the gas powered engine through the water.

The pressurized gas expands within the respective cylinder forcing the piston assembly toward bottom dead center. When the piston assembly reaches bottom dead center, the respective gas port is in registry with the arcuate outlet discharge port formed in the substantially cylindrical valve body. As the piston assembly continues to move toward top dead center, during rotation of the hollow substantially cylindrical housing, the piston assembly exhausts the gas through the outlet discharge chamber, outlet discharge channel, and outlet discharge member to the mouthpiece of the second stage regulator through the gas return line. This configuration permits the use of the pressurized gas to be used by the operator such as in scuba use.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings in which:

FIG. 1 is a perspective view of the gas powered engine.

FIG. 2 is a cross-sectional side view of the gas powered engine.

FIG. 3 is a detailed front view of the attachment means.

FIG. 4 is a detailed cross-sectional side view of the gas distribution means.

FIG. 5 is a rear view of the gas distribution means.

FIG. 6 is a detailed cross-sectional side view of a valve insert for the gas distribution means.

FIG. 7 is a detailed side view of the drive shaft assembly.

FIG. 8 is a front end view of the cylinder assembly.

FIG. 9 is a side view of the cylinder assembly.

FIG. 10 is a side view of the piston assembly.

FIG. 11 is an end view of the swash disc of the swash plate assembly.

FIG. 12 is an end view of the piston lock plate of the swash plate assembly.

Similar reference characters refer to similar parts throughout the several views of the drawing.

DETAILED DESCRIPTION OF THE PREFERRED EMBODIMENT

As shown in FIGS. 1 and 2, the present invention relates to a gas or air powered engine generally indicated as 10 for use with a pressurized gas or air source such as an oxygen reservoir or tank 12 used with a SCUBA system or the like. The gas or air powered engine 10 comprises an engine housing generally indicated as 14 held in spaced relation relative to an outer hollow substantially frustrum housing 16 by an attachment means generally indicated as 18 to cooperatively form a fluid flow chamber 20 therebetween. As shown in FIG. 2, the cross-sectional diameter of the outer hollow substantially frustrum housing 16 decreases from leading edge 24 to trailing edge 22.

As shown in FIGS. 2 and 3, the attachment means 18 comprises a mounting hub generally indicated as 26 held in coaxially spaced relationship relative to the outer hollow substantially frustrum housing 16 by a plurality of interconnecting members 28. The mounting hub 26 comprises an enlarged circular base 30 having a reduced circular extension 32 extending outwardly from the forward portion thereof. A centrally disposed drive shaft receiving channel 34 extends through the mounting hub 26. A bias receiving recess 36 is formed on the rear surface of the enlarged circular base 30 to receive and seat one or more bias or O-rings 38. A securing channel 40 and threaded securing aperture 42 are formed in the reduced circular extension 32 to secure a drive shaft assembly to the mounting hub 26 as more fully described hereinafter. A plurality of bias receiving recesses **44*a* through 44*d* are formed on the rear surface of the enlarged circular base 30 to receive a corresponding bias or spring 46. The bias receiving recesses 44 are specifically disposed relative to each other as shown in FIG. 3** to balance the air or gas pressure.

As best shown in FIG. 2, the engine housing 14 comprises a hollow substantially cylindrical housing and a substantially circular forward wall indicated as 48 and 50 respectively to operatively house a cylinder assembly and swash plate assembly therein. A hollow front cap 52 is disposed forward of the engine housing 14 while a hollow rear cap 54 is attached to the hollow substantially cylindrical engine housing 48.

The gas or air powered engine 10 includes a drive assembly to rotate the engine housing 14 within the outer hollow substantially frustrum housing 16 as more fully described hereinafter. The drive assembly comprises a gas or air distribution means, the drive shaft assembly, the cylinder assembly and the swash plate assembly.

As shown in FIGS. 2 and 4 through 6, the gas or air distribution means comprises a substantially cylindrical valve body 56 having an inlet supply channel 58 and an outlet discharge channel 60 formed on opposite sides of the periphery 62 thereof. An inlet supply member 64 and an outlet discharge member 66 are attached to the substantially cylindrical valve body 56 in open fluid communications with the inlet supply channel 58 and the outlet discharge channel 60 respectively to couple the gas or air distribution means to the pressurized gas or air source 12 as more fully described hereinafter. An inlet supply chamber 68 and an outlet discharge chamber 70 formed in the substantially cylindrical valve body 56 terminate in an arcuate inlet supply port 72 and an arcuate outlet discharge port 74 formed on the inner surface 76 of the substantially cylindrical valve body 56. The inlet supply chamber 68 and the outlet discharge chamber 70 are in open fluid communication with the inlet supply channel 58 and the outlet discharge channel 60 respectively to selectively feed pressurized gas or air to and from the cylinder assembly through the arcuate inlet supply port 72 and the arcuate outlet supply port 74 as more fully described hereinafter. The arcuate inlet supply port 72 comprises an enlarged or primary portion 78 and a reduced or secondary portion 80 extending counter-clockwise through an arc of approximately 15° and 45° respectively with an origin 82 at 180°. The arcuate outlet discharge port 74 extends counter-clockwise through an arc of approximately 150° with an origin 84 at 0°.

As shown in FIG. 6, a valve insert 86 including inlet and outlet apertures 88 and 90 respectively of brass or similar material may be attached to the inner surface 76 of the substantially cylindrical valve body 56 having a periphery 92 inclined outwardly from a substantially flat valve element 94 approximately 30°. The inlet and outlet apertures 88 and 90 are in registry with arcuate inlet supply and outlet discharge ports 72 and 74 respectively. A centrally disposed drive shaft receiving channel 96 is formed in the substantially cylindrical valve body 56. A bias receiving recess 98 and an O-ring recess 100 are formed on opposite sides of the substantially cylindrical valve body 56 to receive the bias 38 and O-ring 101 respectively.

As shown in FIGS. 2 and 7, the drive shaft assembly comprises an elongated main drive shaft 102, eccentric shaft coupler 104 and eccentric drive shaft 106 held in fixed relationship relative to the hollow substantially cylindrical housin9 48. The elongated main drive shaft 102, extending through the centrally disposed drive shaft receiving channel 34, includes a threaded forward recess 108 to receive a threaded fastener 110 therein to secure the hollow front cap 52 to the forward portion of the elongated main drive shaft 102. A securing channel 112 extends through the forward portion of main drive shaft 102 such that when axially aligned with the securing channel 40 of the mounting hub 26 a securing member 114 may be press fitted therethrough. In addition, a threaded fastener 116 may be threaded into threaded securing aperture 42 to engage the side or periphery of the elongated main shaft 102 to further secure the drive shaft assembly to the mounting hub 26. The eccentric shaft coupler 104 includes a first and second shaft recess 118 and 120 respectively to receive the elongated main drive shaft 102 and eccentric drive shaft 106 respectively. Alternately, the eccentric shaft coupler 104 and eccentric drive shaft 106 may be integrally formed. The front surface and rear surface of the eccentric shaft coupler 104 form a first and second shoulder 122 and 124 respectively to engage the cylinder assembly and swash plate assembly respectively. In addition, a threaded recess 126 is formed on the eccentric drive shaft 106 to secure the swash plate assembly to the drive shaft assembly as more fully described hereinafter.

The cylinder assembly can best be understood by reference to FIGS. 2 and 8 through 10. Specifically, the cylinder assembly comprises a substantially cylindrical cylinder block 128 including a plurality of hollow cylinders each indicated as 130 formed therein, secured to the forward portion of the hollow substantially cylindrical housing 48 adjacent the forward wall 50 by fastener 131 or other suitable means. A centrally disposed drive shaft receiving channel 132 extends through the substantially cylindrical cylinder block 128 to receive the drive shaft assembly therethrough. Each hollow cylinder 130 has a gas or air port 134 formed on the substantially circular front wall 50 adjacent the centrally disposed drive shaft receiving channel 132. Corresponding gas or air ports and centrally disposed drive shaft receiving channels are formed in the forward wall 50 and bearing surface insert 138. The bearing surface insert 138 also includes a centrally disposed drive shaft receiving aperture 140 and O-ring recess 142 formed therein. A seal groove 143 is formed on the forward portion of the substantially cylindrical cylinder block 128.

A corresponding piston assembly generally indicated as 144 in FIG. 10 is partially disposed in each of the hollow cylinders 128. Each piston assembly 144 comprises a connecting rod 146 having a cup shaped or concave piston disc 148 attached to the inner end thereof and a spherical element 150 press fitted to the outer end thereof. The spherical element 150 includes a connecting rod recess 152 formed therein having an annular groove 154 formed on the periphery thereof to receive the outer end of the connecting rod 146 that includes an annular ridge 156 formed on the periphery thereof to seat in the corresponding annular groove 154 to secure the connecting rod 154 and spherical element 150 together.

As shown in FIGS. 2, 11 and 12, the swash plate assembly comprises a swash disc and piston lock plate generally indicated as 158 and 160 respectively. The swash disc 158 includes a plurality of hemispherical recesses each indicated as 162 disposed about the circumference thereof to receive a corresponding spherical element 150 therein. A centrally disposed eccentric drive shaft receiving channel 164 is formed in the swash disc 158 to receive the eccentric drive shaft 106 therethrough. A first guide attachment slot 166 extends from the eccentric drive shaft receiving channel 164 through the periphery of the swash disc 158 to receive guide member 168 (FIG. 2) therein. The piston lock plate 160 comprises a plurality of circular apertures each indicated as 170 formed in substantially flat lock plate 172. The cross-sectional diameter of each of the circular apertures 170 is slightly less than the cross-sectional diameter of spherical elements 150. Access openings or channels 174 are formed on the periphery of the substantially flat lock plate 172 to permit the corresponding piston assembly 144 to be operatively mounted in the swash plate assembly. A centrally disposed eccentric drive shaft receiving channel 176 is formed in the substantially flat piston lock plate 172 to receive the eccentric drive shaft 106 therethrough. A second guide attachment slot 178 extends from the eccentric drive shaft receiving channel 176 through the periphery of the substantially flat piston lock plate 172 to receive the guide member 168 when the first and second guide attachment slots 166 and 178 are in registry or alignment relative to each other. A plurality of threaded apertures 180 are formed in the swash disc 158. A corresponding plurality of apertures 182 are formed in piston lock plate 160 to receive fastener means 184 to secure the spherical elements 150 within the corresponding recesses 162 and retained therein by piston lock plate 172.

As shown in FIG. 2, the swash plate assembly is secured to eccentric drive shaft 106 by fastener means 185 extending into a threaded recess 126.

As best shown in FIG. 2, a pair of guide elements each indicated as 186 are fixedly attached to the inner periphery of the hollow substantially cylindrical housing 48 to cooperatively form a guide channel 188 therebetween to operatively receive the guide member 168 to permit reciprocal movement of the swash plate assembly as the swash plate assembly rotates with the cylinder assembly within the engine housing 14 during operation.

A propeller means comprising a plurality of propellers each indicated as 190 is attached to the outer periphery of the engine housing 14 to provide the fluid propulsion motion of the gas or air powered engine 10 as more fully described hereinafter.

In use, the gas or air powered engine 10 is coupled to the pressurized gas or air reservoir or tank 12 by a gas or air supply and return lines 192 and 194 respectively to feed pressurized gas or air to and from the gas or air powered engine 10.

To use, the operator actuates a control means (not shown) to feed pressurized gas or air from the tank 12 to the gas powered engine 10 through gas supply conduit 192. The pressurized gas enters the gas distribution means through the inlet supply member 64 and inlet supply channel 58 to the inlet supply chamber 68. The pressurized gas is introduced into the substantially cylindrical cylinder block 128 in fluid registry with the inlet supply chamber 68 through the arcuate inlet supply port 72 and gas port 134. The arcuate inlet supply port 72 is dimensional to feed two hollow cylinders 130 simultaneously. The pressure of the pressurized gas on the cup shaped piston disc 148 is transmitted through the corresponding connecting rod 146 to the swash plate assembly through the mechanical coupling between the corresponding spherical element 150 and the corresponding hemispherical recess 162. The vectorial relationship between the axial thrust vector of the connecting rod 146 and the inclined swash disc 158 translates into a rotational or rotary component of motion in the swash disc 158 rotating the swash plate assembly. This, in turn, causes the entire substantially cylindrical housing 48 to rotate through the mechanical coupling of the guide member 164 moving reciprocally within the guide channel 188 cooperatively formed between the pair of guide elements 186. This rotational movement causes and permits the propeller blades 190 to move the gas powered engine 10 through the water.

The pressurized gas expands within the respective cylinder 130 forcing the piston assembly toward bottom dead center. When the piston assembly reaches bottom dead center, the respective gas port 134 is in registry with the arcuate outlet discharge port 74 formed in the substantially cylindrical valve body 56. As the piston assembly continues to move toward top dead center, during rotation of the hollow substantially cylindrical housing 48, the piston assembly exhausts the gas through the outlet discharge chamber 70, outlet discharge channel 60, and outlet discharge member 66 to the mouthpiece of the secondary stage regulator through the gas return line 194. This configuration permits the use of the pressurized gas to be used by the operator such as in scuba use.

As shown in FIG. 2, an air or gas exhaust chamber 196 and exit port 198 are formed in the hub 26 to reduce or dampen the exhaust gas, filter the exhaust gas and provide a back pressure against the substantially cylindrical valve body 56.

It will thus be seen that the objects set forth above, among those made apparent from the preceding description are efficiently attained and since certain changes may be made in the above construction without departing from the scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described, what is claimed:

1. A gas powered engine for use in combination with a pressurized gas source to propel the gas powered engine through a fluid medium such as water comprising an engine housing having a plurality of blades formed on the outer periphery thereof rotatably held in fixed spaced relationship to an outer hollow housing by an attachment means to cooperatively form a fluid flow chamber therebetween, said engine housing comprising a hollow housing to operatively house a drive assembly therein, said drive assembly comprising a drive shaft assembly coupled to said attachment means in fixed relationship relative to said outer hollow housing, a gas distribution means coupled to said drive shaft assembly, and a cylinder assembly and a swash plate assembly rotatably mounted on said drive shaft assembly, said cylinder assembly and said swash plate assembly being rotatably fixed relative to said engine housing, said gas distribution means being operatively disposed between the pressurized gas source and said cylinder assembly to selectively feed and discharge pressurized gas to and from said cylinder assembly, said cylinder assembly comprising a cylinder block having a plurality of hollow cylinders formed therein to receive a corresponding plurality of piston assemblies therein for reciprocal movement within said corresponding hollow cylinders for translational movement of said swash plate assembly in response to the pressurized gas fed to said piston assemblies to rotate said engine housing to propel said gas powered engine through the water.

2. The pressurized gas engine of claim 1 wherein said outer hollow housing comprises an outer hollow substantially frustum housing having a leading edge of a greater cross sectional diameter than the trailing edge thereof.

3. The pressurized gas engine of claim 1 wherein said attachment means comprises a mounting hub in coaxial spaced relationship relative to said outer hollow housing by a plurality of interconnecting members.

4. The pressurized gas engine of claim 3 wherein said mounting hub comprising an enlarged circular base.

5. The pressurized gas engine of claim 4 wherein said mounting hub includes a reduced circular extension extending outwardly from the forward portion of said enlarged circular base.

6. The pressurized gas engine of claim 5 wherein said reduced circular extension includes a securing channel and threaded securing aperture formed therein to receive a portion of said drive shaft assembly thereon.

7. The pressurized gas engine of claim 4 wherein said mounting hub further includes a centrally disposed drive shaft receiving channel formed therein to receive a portion of said drive shaft assembly therethrough.

8. The pressurized gas engine of claim 7 wherein said enlarged circular base further includes a bias receiving recess formed in the rear portion of said enlarged circular base concentrically disposed relative to said centrally disposed shaft receiving channel to receive and seat a bias therein.

9. The pressurized gas engine of claim 8 wherein said enlarged circular base further includes at least one secondary bias receiving recess formed on the rear surface thereof to receive a bias therein, said bias being disposed between said mounting hub and said gas distribution means.

10. The pressurized gas engine of claim 1 wherein said hollow housing comprises a hollow substantially cylindrical housing and a substantially circular forward wall to operatively house said cylinder assembly and said swash plate assembly therein.

11. The pressurized gas engine of claim 10 further including a hollow front cap disposed forward of said engine housing and a hollow rear cap attached to the rear portion of said hollow substantially cylindrical engine housing.

12. The pressurized gas engine of claim 1 wherein said gas distribution means comprising a substantially cylindrical valve body having an inlet supply channel and an outlet discharge channel formed in the periphery thereof to selectively feed and discharge pressurized gas to and from said cylinder assembly respectively.

13. The pressurized gas engine of claim 12 further including an inlet supply member and an outlet discharge member attached to said substantially cylindrical body in open fluid communication with said inlet supply channel and said outlet discharge channel respectively to couple said gas distribution means to the pressurized gas source.

14. The pressurized gas engine of claim 12 further including an inlet supply chamber and an outlet discharge chamber formed in said substantially cylindrical valve body terminating in an arcuate inlet supply port and an arcuate discharge port formed on the inner surface of said substantially cylindrical valve body in fluid communication with said inlet supply channel and said outlet discharge channel respectively to selectively feed pressurized gas to and from said cylinder assembly through said arcuate inlet respectively.

15. The pressurized gas engine of claim 14 wherein said arcuate inlet supply port is dimensioned to feed two of said hollow cylinders simultaneously.

16. The pressurized gas engine of claim 14 wherein said arcuate inlet supply port comprises a primary portion and a secondary portion extending through an arc of approximately 15° and 30° respectively.

17. The pressurized gas engine of claim 14 wherein said arcuate outlet discharge port extends through an arc of approximately 150 °.

18. The pressurized gas engine of claim 12 wherein said substantially cylindrical valve body includes a drive shaft receiving channel formed therethrough to receive a portion of said drive assembly therethrough.

19. The pressurized gas engine of claim 12 wherein said substantially cylindrical valve body includes a bias receiving recess and an O-ring recess formed on opposite ends thereof to receive a bias and O-ring therein respectively.

20. The pressurized gas engine of claim 1 wherein said drive shaft assembly comprises an elongated main drive shaft operatively coupled to an eccentric drive shaft disposed in angular relationship relative thereto within said hollow housing.

21. The pressurized gas engine of claim 20 wherein said elongated main drive shaft is operatively coupled to said eccentric drive shaft by eccentric shaft coupler, said eccentric shaft coupler including a first and second shaft recess to receive an elongated main drive shaft and said eccentric drive shaft respectively.

22. The pressurized gas engine of claim 21 wherein said eccentric shaft coupler includes a first and second shoulder to engage said cylinder assembly and said swash assembly respectively.

23. The pressurized gas engine of claim 1 wherein said cylinder block is secured to the forward portion of said hollow housing adjacent.

24. The pressurized gas engine of claim 23 wherein each said hollow cylinder includes a gas port formed therein in selective fluid communication relative to said gas distribution means.

25. The pressurized gas engine of claim 24 wherein said cylinder block includes a centrally disposed drive shaft receiving channel extending therethrough to receive a portion of said drive shaft assembly therein.

26. The pressurized gas engine of claim 23 wherein the forward portion of said cylinder block includes a bearing surface insert having a centrally disposed drive shaft receiving aperture and O-ring recess formed therein to receive a portion of said drive shaft assembly and at least one sealing O-ring thereon respectively.

27. The pressurized gas engine of claim 1 wherein each said piston assembly comprises a connecting rod having piston disc attached to inner end thereof and a spherical element attached to the outer end.

28. The pressurized gas engine of claim 27 wherein each said piston disc is cup shaped to receive the pressurized gas therein.

29. The pressurized gas engine of claim 27 wherein said each spherical element includes a connecting rod recess formed therein having an annular groove formed on the inner pheripheral thereof to receive the outer end of said connecting rod including an annular ridge formed on the pheriphery thereof to seat said corresponding annular groove to secure said connecting rod to said respective spherical element.

30. The pressurized gas engine of claim 27 wherein said swash plate assembly includes a swash disc having a plurality of spherically formed recesses disposed about the circumference thereof to receive said spherical elements of said piston assembly.

31. The pressurized gas engine of claim 30 wherein said swash plate assembly further includes a piston lock plate attached to said swash disc to operatively couple said spherical elements to said swash plate assembly.

32. The pressurized gas engine of claim 31 wherein said swash disc and said piston lock plate each include an attachment slot formed in the periphery thereof to receive a guide member formed on said swash plate therein.

33. The pressurized gas engine of claim 32 wherein a pair of guide elements are affixed to the inner periphery of said hollow housing to cooperatively form a guide channel therebetween to operatively receive said guide member to permit reciprocal movement of said swash plate assembly within said hollow housing as said swash plate assembly reciprocally moves with said cylinder assembly and said engine housing.

34. The pressurized gas engine of claim 31 wherein said piston lock plate includes an access channel formed on the periphery thereof to permit said corresponding piston assembly to be operatively coupled to said swash plate assembly.

35. The pressurized gas engine of claim 31 wherein said piston lock plate comprises a plurality of circular apertures formed in a substantially flat lock plate, the cross sectional diameter of each of said circular apertures being less than the cross sectional diameter of each of said spherical elements of said piston assembly.

* * * * *